United States Patent [19]

Wenger

[11] Patent Number: 4,511,140

[45] Date of Patent: Apr. 16, 1985

[54] BOWLING BALL RETAINER-TOWEL DEVICE

[76] Inventor: Robert L. Wenger, 206 W. Michigan St., LaGrange, Ind. 46761

[21] Appl. No.: 512,202

[22] Filed: Jul. 7, 1983

[51] Int. Cl.[3] ..... A63D 5/00

[52] U.S. Cl. ..... 273/54 B; 273/63 R; 428/172; 211/14; 248/346; 15/210 R

[58] Field of Search ..... 211/14; 224/919; D6/265; 294/141, 142; 248/346, 354 L; 428/172; 273/63 R, 54 R, 54 B; 15/210 R

[56] References Cited

U.S. PATENT DOCUMENTS 4,305,584 12/1981 Leehan ..... 224/919 X

*Primary Examiner*—Alexander S. Thomas

*Attorney, Agent, or Firm*—George A. Gust

[57] ABSTRACT

A bowling ball retainer-towel device comprising a panel-like towel of flexible fabric such as terry cloth having a ring-shaped embossment sewn thereto and spaced inwardly of the edges thereof. When the combination towel is laid on a flat surface, a bowling ball may be disposed on and within the embossment which prevents the ball from rolling. When not being so used, the towel combination may be used conventionally for wiping and drying.

6 Claims, 3 Drawing Figures

BOWLING BALL RETAINER-TOWEL DEVICE

BACKGROUND OF THE INVENTION

1. Field of the Invention

This invention relates to a towel device and more particularly to a combination towel device adapted to retain a bowling ball from rolling when set upon a flat surface, and when not being so used, for wiping and drying the same as a conventional towel.

2. Description of the Prior Art

Bowling enthusiasts conventionally use terry cloth towels for wiping and/or drying their hands during participation in a bowling game. When not bowling, the player conventionally carries the ball to and from the bowling alley or the building containing the bowling alley and occasionally places the ball onto a flat surface, such as a table or countertop. It is not uncommon for a ball to roll away and accidentally to fall onto a floor surface or the like.

SUMMARY OF THE INVENTION

The present invention pertains to a bowling ball retainer-towel device which includes a panel-like towel of flexible fabric and a ring-shaped embossment secured to the towel well within the edges thereof. The embossment may be in the form of a braided nylon rope sewn in place on the towel by means of a sub-panel of towel fabric disposed thereover. The sub-panel is itself sewn to the basic towel panel with the nylon rope element being sandwiched therebetween. The two panels preferably are sewn at the inner and outer perimeters of the ring-shaped rope, and the sub-panel is also sewn to the main panel about its marginal edges. The rope element itself is of a flexibility comparable with that of the main panel such that the combination may be used for wiping and drying in a conventional manner. Laid on a flat surface, the towel device presents a raised embossment into which a bowling ball may be nested. The embossment restrains the ball from rolling.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
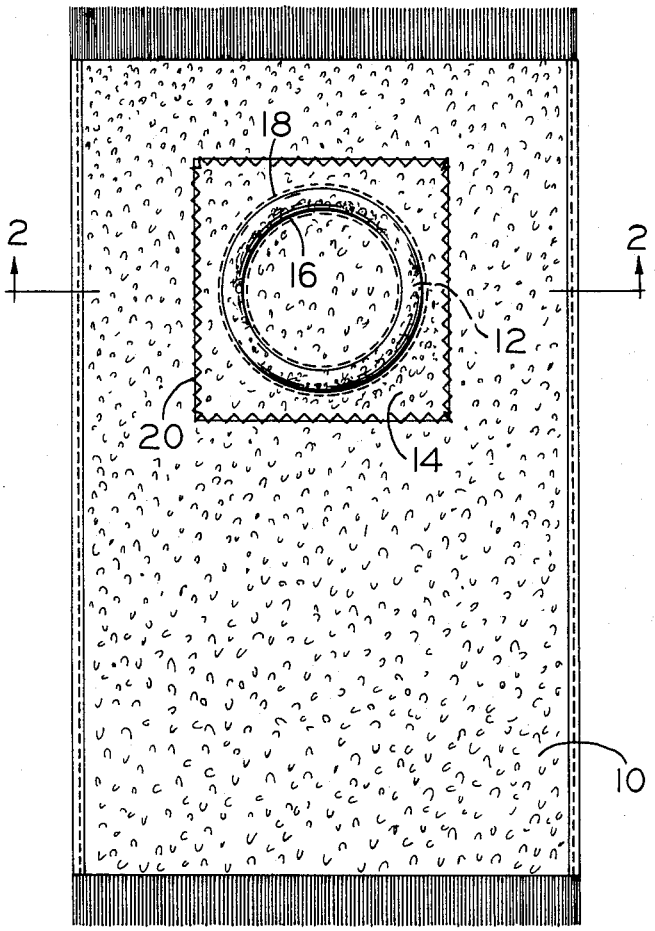
FIG. 1 is a front plan view of one embodiment of this invention.
Figure 2:
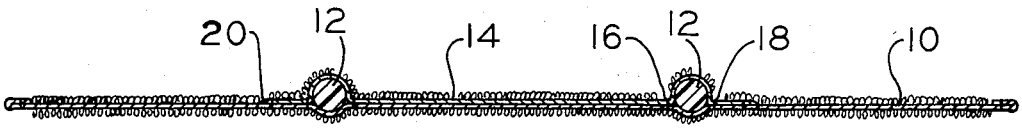
FIG. 2 is a cross-section taken substantially along section line 2—2 thereof.

Referring to the drawings, a panel 10 may be a conventional towel formed of, for example terry cloth. Superposed on the panel 10 is a loop shaped (such as annular) element 12 of semi-rigid material which is also flexible. This element may be formed of conventional braided nylon rope having the ends thereof fused together to form the ring shape.

Superposed over the ring-shaped element 12 is a sub-panel 14 of fabric like that of the panel 10, this sub-panel 14 being of a some suitable shape, such as square. With the sub-panel 14 in place, the assembly is sewn together in three different positions, at the inner and outer peripheries 16 and 18 of the ring-shaped element 12 and also at the edges 20 of the sub-panel 14. Preferably, the element 12 is disposed well within the edges of the panel 10 in a proportion about as shown in FIG. 1.

For a working embodiment of this embodiment, the panel 10 may have a width of about eleven inches and a length of about seventeen inches. The sub-panel 14 may have edge dimensions of about five inches, and the inner diameter of the ring-shaped embossment 12 is about two and three-quarter inches. The rope element 12 may be fabricated a of a ten inch length of conventional braided nylon rope which is $\frac{3}{8}$" in diameter. The ends of the rope are fused together by means of a match flame into a circular shape as shown.

The combination of the ring-shaped embossment 12 and the two panels 10 and 14 have a degree of flexibility comparable to that of the panel 10 such that the towel device may be used in a conventional manner for wiping and drying. Also, the towel device may be laid upon a flat surface such as a table top, and a bowling ball set within the ring-shaped embossment 12 for the purpose of preventing it from rolling off the surface.

Figure 3:
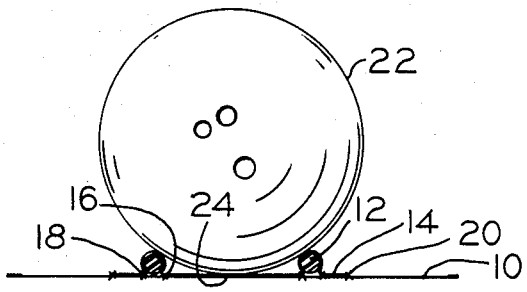
FIG. 3 is a side view partly sectioned of a bowling ball resting in retained position on the device.

More particularly, the height and diameter of the embossment 12 is as shown in FIG. 3 wherein the towel device is shown laid on a flat surface and a bowling ball 22 set within embossment 12 to be retained thereby. The ball 22 contacts and rests on the flat surface in the center portion 24 of the embossment 12 and may lightly engage the inner perimeter of the embossment 12 thereby being prevented from rolling in any direction. The inner diameter may be somewhat larger so long as the ball is restrained against rolling to such an extent as would roll over the embossment 12. Also the height of the embossment may be increased so long as the flexibility of the device as a towel is retained. The element 12 while not rigid is sufficiently rigid to stand against the rolling force of the ball and to not be crushed thereby to an extent as would easily permit the ball 22 to roll thereover. The inner diameter of the ring-shaped embossment 12 it thus smaller than the diameter of the bowling ball 22 with the height preferably being such as first contacts a corresponding circular portion of the ball 22 as shown.

While the word "loop-shaped" is used hereinabove and also in the claims appended hereto to describe the embossment 12, it is intended that this term shall cover shapes other than annular, such as square, hexagonal and the like. The panel 10 is of extended area, uninterrupted from edge to edge and lies flat on a planar surface as does the embossment 12.

While this invention has been described as having a preferred embodiment, it will be understood that it is capable of further modification. This application is therefor intended to cover any variations, uses, or adaptations of the invention following the general principles thereof, and including such departures from the present disclosure as come within known or customary practice in the art to which this invention pertains and fall within the limits of the appended claims.

What is claimed is:

1. A bowling ball retainer-towel device comprising an extended uninterrupted area, panel-like towel of flexible fabric that lies in a flat plane when laid on a flat surface, and a loop-shaped annular embossment lying in the plane of said fabric having "towel flexibility" and of a fixed diameter smaller than a bowling ball being secured to said towel and spaced inwardly of the edges thereof, said embossment being relatively rigid thereby to serve as a raised obstruction to restrain rolling of a bowling ball placed thereinside while said fabric with said embossment is laid flat on a flat surface.

2. The device of claim 1 wherein said towel fabric is terry cloth, said embossment includes a ring-shaped element of semi-rigid flexible material sewn in place on said towel.

3. The device of claim 3 wherein said element is of braided nylon rope superposed on said towel, a sub-panel of towel fabric laid over said element and sewn to said towel about the inner and outer perimeters of said element.

4. The device of claim 3 wherein said sub-panel is further sewn to said towel at the marginal edges thereof.

5. The device of claim 1 wherein said embossment has "ball-retaining" parameters.

6. The device of claim 5 wherein said embossment is ring-shaped having an inner diameter of about two and three-quarter inches and a height of about three-eighths inch.

* * * * *